US009048589B2

(12) United States Patent
Poorter et al.

(10) Patent No.: US 9,048,589 B2
(45) Date of Patent: Jun. 2, 2015

(54) SHIELDING SHELL FOR A CONNECTOR

(75) Inventors: Peter Poorter, Wijk En Aalburg (NL); Nico Van Stiphout, DK Beek En Donk (NL); Ton Karsmakers, ZD Oss (NL)

(73) Assignee: FCI, Guyancourt (FR)

( * ) Notice: Subject to any disclaimer, the term of this patent is extended or adjusted under 35 U.S.C. 154(b) by 768 days.

(21) Appl. No.: 13/262,315

(22) PCT Filed: Mar. 29, 2010

(86) PCT No.: PCT/EP2010/054089

§ 371 (c)(1), (2), (4) Date: Feb. 13, 2012

(87) PCT Pub. No.: WO2010/112457

PCT Pub. Date: Oct. 7, 2010

(65) Prior Publication Data

US 2012/0138356 A1 Jun. 7, 2012

(30) Foreign Application Priority Data

Mar. 31, 2009 (WO) ..... PCT/IB2009/053461

(51) Int. Cl.

| | |
|---|---|
| ***H01R 13/648*** | (2006.01) |
| ***H01R 13/6583*** | (2011.01) |
| *H01R 43/16* | (2006.01) |
| *H01R 12/70* | (2011.01) |

(52) U.S. Cl.

CPC ..... *H01R 13/6583* (2013.01); *H01R 43/16* (2013.01); *H01R 12/707* (2013.01)

(58) Field of Classification Search

CPC ..... H01R 13/6583
USPC ..... 174/359
See application file for complete search history.

(56) References Cited

U.S. PATENT DOCUMENTS

| | | | | |
|---|---|---|---|---|
| 5,378,172 | A | 1/1995 | Roberts | 439/607 |
| 6,699,071 | B1 * | 3/2004 | Hyland | 439/607.19 |
| 7,033,210 | B1 | 4/2006 | Laurer et al. | 439/541.5 |
| 8,438,893 | B2 * | 5/2013 | Durney et al. | 72/324 |
| 2006/0228944 | A1 * | 10/2006 | Tsai | 439/607 |
| 2007/0066137 | A1 * | 3/2007 | Yang | 439/607 |
| 2010/0035466 | A1 * | 2/2010 | Lee et al. | 439/541.5 |

FOREIGN PATENT DOCUMENTS

WO WO 03/098752 A1 11/2003

* cited by examiner

*Primary Examiner* — William H Mayo, III
*Assistant Examiner* — Hiram E Gonzalez
(74) *Attorney, Agent, or Firm* — Harrington & Smith

(57) ABSTRACT

A Shielding shell for a connector is disclosed which includes a first wall, a second wall and a third wall. The first wall, the second wall and the third wall are arranged mutually at an angle to each other. At least the first wall and the second wall are connected to each other by a first folded edge. The shielding shell further includes a first contact portion connected with the second wall by a second folded edge, the first contact portion being arranged substantially parallel to the third wall and including a plurality of contact segments contacting said third wall.

11 Claims, 3 Drawing Sheets

SHIELDING SHELL FOR A CONNECTOR

TECHNICAL FIELD

The present disclosure relates to the field of connectors, in particular to the field of shielding arrangements for connectors, more in particular to a shielding shell for a connector.

BACKGROUND

Connectors for connecting one or more signals may require shielding against electromagnetic noise generated or received by carriers along which the signals are transmitted. Such shielding may efficiently be provided in the form of a shielding shell comprising conducting material which covers at least a portion of the connector.

When designing and manufacturing such a shielding shell and a connector comprising such shell, a compromise has to be found between shielding efficiency, material consumption and manufacturing ease. Manufacturing a shield by folding a sheet of material, e.g. a metal sheet, about (a portion of) a connector terminal housing has proven a useful technique for providing a shielding shell. However, the technique of folding may generally provide limited accuracy, which may require significant effort and cost for meeting manufacturing tolerances and providing adequate shielding.

With the ongoing trend of miniaturization and increasing signal speed the aforementioned problems become more acute.

Consequently, there is a demand for an improved shielding shell addressing these problems.

SUMMARY

In one aspect, a shielding shell is provided. The first, second and third walls of the shielding shell allow covering a connector body of a connector at least partially. The first folded edge facilitates manufacturing. It also allows adapting the angle between the first and second walls to fit a connector body to be shielded. The first contact portion allows providing proper contact between the second and third walls. This improves the shielding efficiency of the shielding shell. The plurality of contact segments ensures a plurality of contact points between the second and third walls. The separation between contact points defines a maximum wavelength of EMI radiation which may inadvertently escape through a space between the contact points, which translates into a minimum frequency of such escaping signal. By providing a plurality of contact points the minimum escape frequency can be determined so as to define a frequency range which is not experienced or considered as noise to and/or which is substantially absent from signals to which the connector is (configured to be) exposed. Providing a shielding shell with a plurality of contact segments instead of a single segment thus provides an improved shielding. It further facilitates manufacturing since the individual segments may adapt or be adapted to contact portions of the third wall with different tolerances, e.g. a somewhat inaccurate relative position and/or angle between the first, second and/or third walls. Thus, proper contacting between the third wall and the contact segments may be ensured. As a consequence folding tolerances may slacken whereas a proper shielding may still be ensured. The efficiency and reliability of the shielding shell may be further enhanced by providing one or more of the contact segments with a resilient portion, allowing the considered contact segment to exhibit a spring finger action.

The shielding shell allows an end edge of the third wall to be hidden behind the first, substantially continuous, portion and thus allows preventing apertures in the shielding shell. This reduces chances of leaking radiation through the slots and thus improves the shielding efficiency of the shielding shell.

The shielding shell allows providing the first, second and third walls as a substantially unitary shielding shell, which may facilitate manufacturing of the shielding shell. It may also substantially prevent gaps from occurring between the first wall and the third wall. Thus, the shielding efficiency is further improved.

The shielding shell facilitates folding the shielding shell into a desired shape. The first and/or second leading edge portions may be shaped in various ways, e.g. by a beveled edge or by a portion of the edge being bent out of a main plane or direction in which the particular wall or contact portion extends. Preferably, the first and/or second leading edge portions are arranged for being the point or zone subject to a first contact between the first contact portion and the third wall during folding of the first and second walls along the first folded edge.

The shielding shell allows forming the second leading edge portions, e.g. by deflection out of a plane in which the third wall extends, whereas one or more other portions of the third wall are unaffected by the presence of the second leading edge portions. Examples are a folded edge, a portion comprising one or more contact terminals and/or a portion configured for abutting a portion of a further object such as a connector body. This facilitates manufacturing of the shielding shell, and allows adhering to tolerances of the one or more other portions.

The shielding shell may comprise one or more further walls for further enveloping a connector body. The shielding shell is particularly suitable for an angle connector, e.g. a right angle connector or a 45 degree connector.

The shielding shell facilitates optimizing usage of space in a device in which the shielding shell is to be used. It may in particular be used for substantially right-angled connectors.

A shielding shell according to the above description may suitably be manufactured by forming the blank and folding the blank. The blank may be made with or from sheet material, e.g. a metal sheet, and may be formed by cutting, stamping or other suitable ways.

BRIEF DESCRIPTION OF THE DRAWINGS

The invention will hereafter be more fully explained with reference to the drawings, showing an embodiment of the invention by way of example.

DETAILED DESCRIPTION

Figure 1A:
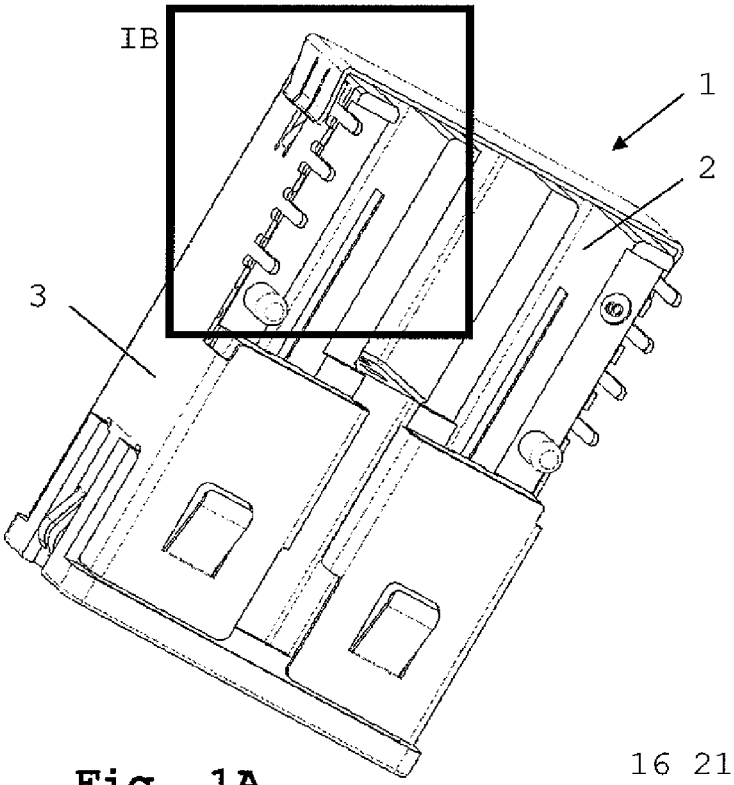
FIG. 1A is a perspective bottom view of a connector.
Figure 1B:
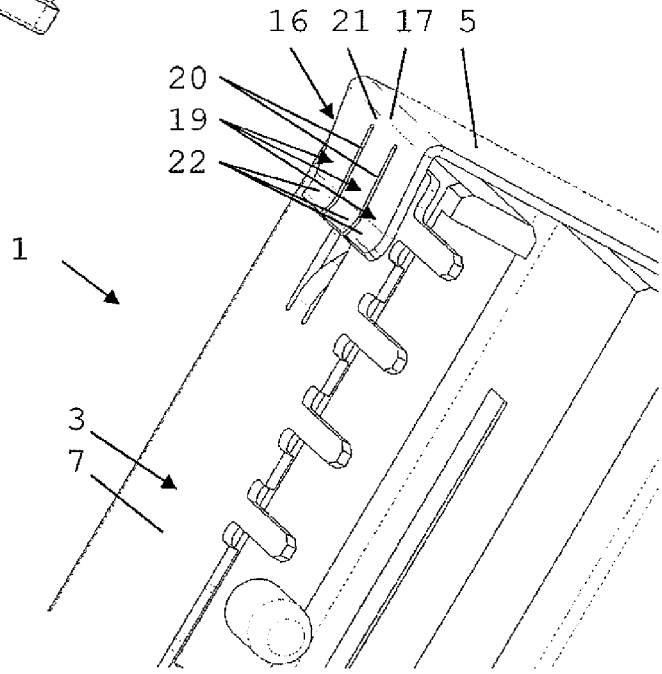
FIG. 1B shows detail IB of FIG. 1A on an enlarged scale.
Figure 2:
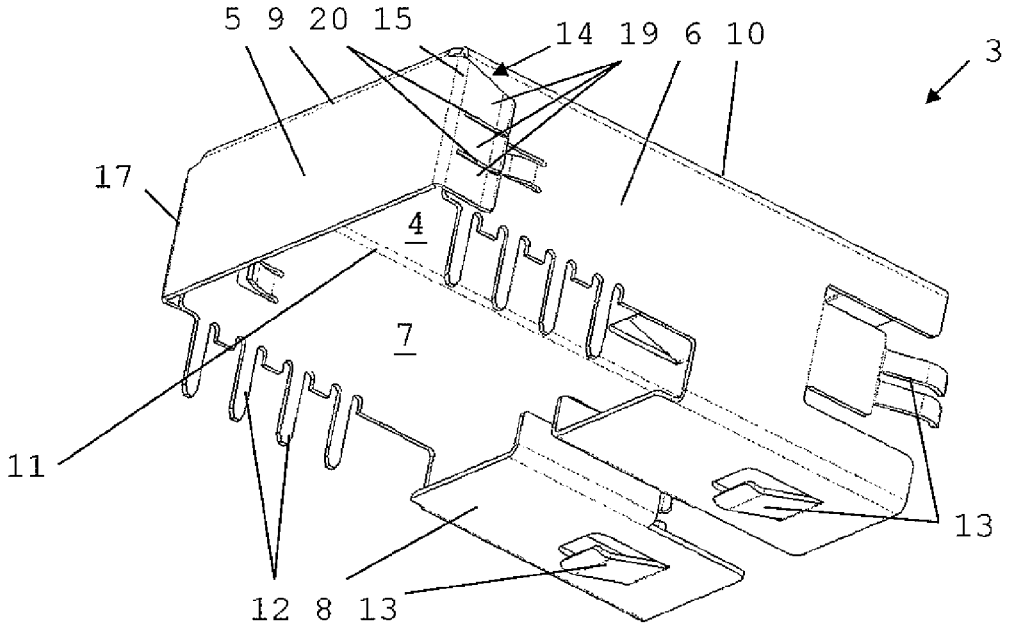
FIG. 2 is a perspective view of the shielding shell of FIG. 1A.

FIGS. 1A and 1B show a connector 1 comprising a connector body 2 and a shielding shell 3. The shielding shell 3 is shown in FIG. 2. FIGS. 3A-3E show a shielding shell generally similar to the shielding shell 3 of FIGS. 1A-2, except for some minor details to be discussed below. In the drawings and the following discussion, like features are indicated with the same reference signs.

The shown connector 1 is a right-angle connector which is configured for being mounted to a further object, in particular a circuit board (not shown). The shielding shell 3 comprises a first wall 4 on its top side, a second wall 5 on its rear side, third and fourth walls 6 and 7, respectively, on substantially opposite sides and further wall portions 8 on its bottom side. The shielding shell 3 is fitted to the connector body 2, primarily by interaction between the wall portions 8 and further portions protruding from them, which are received in the connector body 2. Thus the connector body 2 and the shielding shell 3 are fixed together.

The used references to top, rear, side and bottom, etc, are relative to the connector 1 as shown in the drawings and for purposes of facilitating the further description and should not be construed as limiting the scope of the present disclosure.

The shown shielding shell 3 is a substantially unitary object manufactured by folding an appropriately formed blank. Thus, the first wall 4 and the second wall 5 are connected to each other by a first folded edge 9, the first wall 4 and the third wall 6 are connected to each other by a folded edge 10 and the first wall 4 and the fourth wall 7 are connected to each other by a folded edge 11. The further wall portions 8 are likewise connected to the third and fourth walls 6, 7 by further folded edges. In the shown shielding shell 3 each wall 4-7 and wall portion 8 is arranged at a mutually substantially perpendicular angle to each adjacent wall (portion) 4-8, although other angles may be envisioned. Contact legs 12 protrude from the third and fourth walls 6, 7 for contacting the shielding shell to further structures such as one or more ground contacts on a further object, e.g. a circuit board.

The shown shielding shell 3 comprises a plurality of contact springs, generally indicated with reference numeral 13, which are arranged at various locations on the walls 4-8 for contacting further objects such as wall portions of a device, e.g. edges of a port opening of a front panel into which the connector is received. This may provide and/or improve contact between the shielding shell 3 and different portions of the object, and therewith interconnecting the different portions of the object themselves, preventing build-up of potential differences between the shielding shell and (portions of) the object. This improves shielding efficiency of the assembly of connector 1 and the object and may further protect connected electronics against static discharge. The contact springs 13 may also generally improve fixation of the shielding shell 3 and thus of connector 1 to the object.

The shielding shell 3 further comprises a first contact portion 14 extending from the second wall 5 and connected with it by a folded edge 15 and a second contact portion 16 extending from the second wall 5 connected with it by a folded edge 17. The first contact portion 14 is arranged substantially parallel to the third wall 6. The second contact portion 16 is arranged substantially opposite the first contact portion 14 with respect to the second wall 5 and it is substantially parallel to the fourth wall 7. The first and second contact portions 14, 16 each comprise a plurality of contact segments 19, each of which engaging the third and fourth walls 6, 7, respectively, making electrical contact thereto. One or more contact segments 19 preferably comprise a resilient portion for improving the contact pressure between the contact segment 19 and the appropriate wall 6, 7. The contact segments 19 are separated by slots 20 which extend from a far end of the contact portion 14, 15, relative to the folded edges 15, 17, towards but not all the way up to the folded edge 15, 17. Thus each contact portion 14, 16 comprises a first portion 21 which is substantially continuous along and adjacent the folded edge 15, 17, respectively, in addition to a second portion comprising the contact segments 19 and the slots 20.

The length of the slots 20, and thus the width of the first portion 21 of the contact portions 14, 16 are configured such that the first portion 21 masks an edge of the third wall 6 or fourth wall 7 substantially preventing apertures through the shielding shell between third wall 6 and/or fourth wall 7 and the contact portion 14, 16.

As may be most clearly seen in FIGS. 1B and 3A-3E, the (contact segments 19 of the) first and second contact portions 14, 16 comprise a first leading edge portion 22 arranged towards the far end of the contact portions 14, 16, relative to the folded edges 15, 17, which deflects with respect to a main plane in which the corresponding contact portion 14, 16 substantially extends.

Figure 3A:
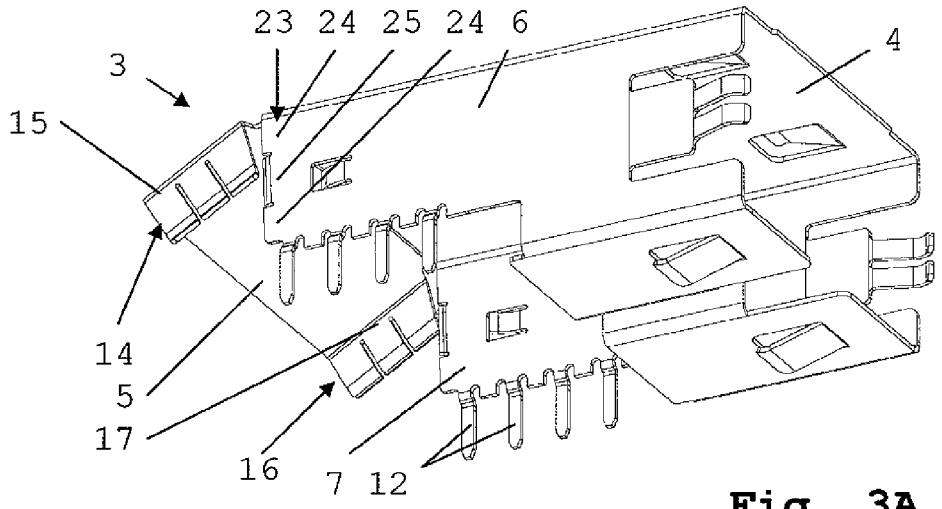
FIGS. 3A-3E are perspective views indicating different steps of a method of folding a shielding shell.
Figure 3B:
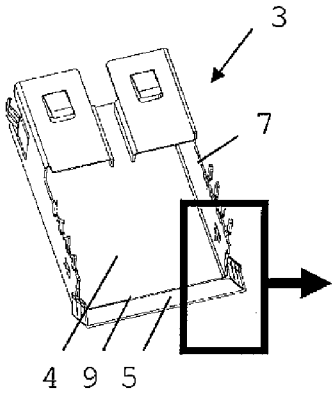
Figure 3C:
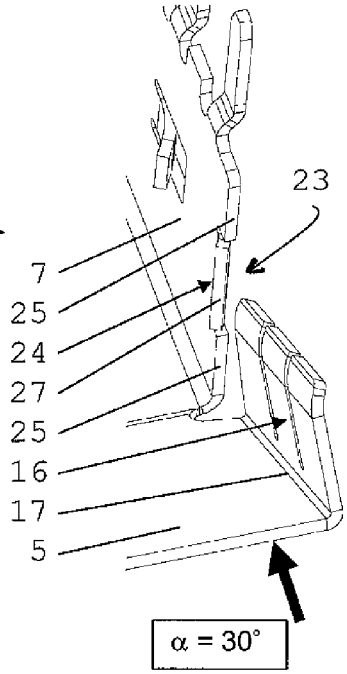
Figure 3D:
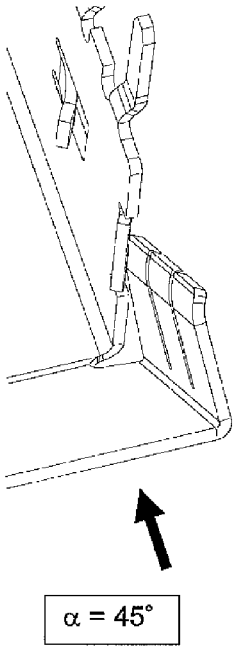
Figure 3E:
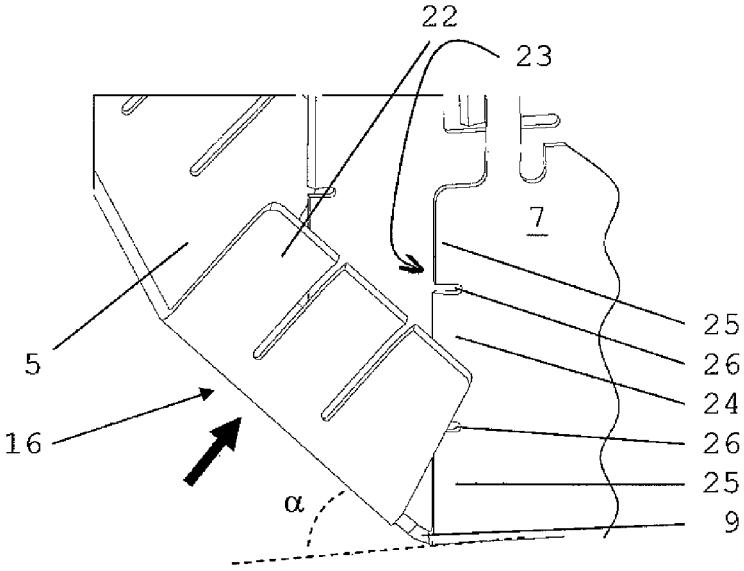

FIGS. 3A-3E show (portions of) a shielding shell 3 which is substantially identical with the shielding shell 3 of FIGS. 1A-2, the main difference being that the contact legs 12 are slightly bent out of a main plane of extension of the third and fourth walls 6, 7, respectively, so as to fit a different object. FIGS. 3A-3E show different views of different steps of manufacturing the shielding shell 3 by folding from an appropriately formed blank, which may be a conductive, e.g. metal, sheet. FIGS. 3C-3E are partial views as indicated in FIG. 3B. First, the blank is cut or stamped and formed in one or more steps to provide a structure which is substantially tubular shaped and in which the first and second contact portions 14, 15 are folded along the folded edges 15, 17 (FIGS. 3A, 3B). When the second wall 5 is not folded, the folded edges 15,17 may be externally shifted with regard to the folded edges 10, 11 (it can still be seen on FIGS. 3C-3D, even if the second wall 5 is partially folded). Such a design allows folding the contact portions 14, 16 with an angle of less than 90° with regard to the second wall 5. Then, the contact portions may be prestressed and consequently they may apply a higher strength on the third and fourth walls 6, 7.

In a following folding step the first and second walls 4, 5 are folded along the folding edge 9 to finish forming the shielding shell (see arrows in FIGS. 3C-3E). In this folding step, the leading edge portions 22 ensure that the contact portions 14, 16 are smoothly guided onto the appropriate surfaces of the third and fourth walls 6, 7 as from their moment of engaging the respective third and fourth walls 6, 7, here at a folding angle $\alpha$ of about 45 degrees, facilitating the folding process and hence the entire manufacturing process of the shielding shell 3. As seen most clearly in FIGS. 3A, 3C and 3D, the third and fourth walls 6, 7 each comprise an edge portion 23 which in turn comprises first wall segments 24 and second wall segments 25, separated by slots 26. The first wall segments 24 are provided with a second leading edge portion 27 deflecting inwardly from a main plane in which the third wall 6 or fourth wall 7 respectively extends. Thus, the first wall portion 24 is shaped such that the corresponding contact portion 14, 16 is guided onto the desired surface of the corresponding third wall 6 to fourth wall 7.

The first and second leading edge portions 22, 27 are arranged for being the portion(s) subject to the first contact between the third wall 6 or fourth wall 7 and the corresponding contact portion 14, 15, with respect to the folding direction about the first edge 9. In the shown embodiment such first contact is established at a folding angle $\alpha$ of about 45 degrees from the unfolded situation between the first and second walls 4, 5 (FIGS. 3D, 3E).

The combination of the first and second leading edges 22, 27 allows maintaining a guiding efficiency during the folding step of the engaging walls.

The actual folding angle $\alpha$ at which first contact is established between a contact portion and the according wall depends on the actual shape of the considered wall edge portion and the contact portion. The optimum position of a first wall segment and a further wall segment may therefore be different from the shown embodiment.

The finished shielding shell 3 may then be mounted to or assembled with the connector body 2 to provide a shielded connector 1. Alternatively, one or more folding steps for forming the shielding shell 3 may be performed directly around the connector body 2.

In the finished shielding shell 3 (FIG. 2) one or both contact portions 14, 16 assist maintaining the position of the third and/or fourth walls 6, 7 by preventing folding-out of the third and/or fourth walls 6, 7 with respect to the first (top) wall 4, thereby assisting clamping the shielding shell 3 to the connector body 2 and/or true-positioning of the contact legs 12.

The invention is not restricted to the above described embodiments which can be varied in a number of ways within the scope of the claims. For instance the first and/or second contact portion may be arranged at an inside of the shielding shell, opposite to the shown embodiments.

The shielding shell may have more walls and corresponding contact portions arranged according to the disclosure. Different contact portions may have mutually different orientations and/or shapes and sizes.

Wall portions 8 may be shaped differently or be absent, e.g. in accordance with another function and/or another attachment method between the shielding shell and the connector body.

Further, the shielding shell may comprise more, less and/or differently arranged contact legs 12, e.g. extending from the rear side (second wall 5) or bottom side (wall portions 8) of the shielding shell.

Elements and aspects discussed in relation with a particular embodiment may be suitably combined with other embodiments.

The invention claimed is:

1. Shielding shell for a connector comprising a first wall, a second wall and a third wall, wherein the first wall, the second wall and the third wall are arranged mutually at an angle to each other, and at least the first wall and the second wall are connected to each other by a first folded edge, wherein the shielding shell further comprises a first contact portion connected with the second wall by a second folded edge, the first contact portion being arranged substantially parallel to the third wall and comprising a plurality of contact segments contacting said third wall, wherein the first contact portion is shaped to engage the third wall during folding the first wall and second wall along the first folded edge, wherein the third wall is provided with a second leading edge portion shaped such that the first contact portion is guided onto a surface of the third wall upon engaging the third wall, and where the second leading edge portion at least partially forms a leading edge of the third wall, where the leading edge at the second leading edge portion is inwardly deflectable by at least one of the contact segments as the contact segments come into contact with the third wall, where the third wall comprises a plurality of separate segments formed by at least one slot into the leading edge, and where at least one of the separate segments comprises the second leading edge portion.

2. Shielding shell according to claim 1, wherein the first contact portion comprises a first portion which is substantially continuous along and adjacent the second folded edge and a second portion adjacent the first portion, away from the second folded edge comprising the contact segments, and wherein the contact segments of the first contact portion are separated by at least one slot extending in a direction towards the second folded edge.

3. Shielding shell according to claim 1, wherein the first wall and the third wall are connected to each other by a third folded edge.

4. Shielding shell according to claim 1, wherein the first contact portion is shaped to engage the third wall during folding the first wall and second wall along the first folded edge and wherein the first contact portion is provided with a first leading edge portion shaped such that the first contact portion is guided onto a surface of the third wall upon engaging the third wall.

5. Shielding shell according to claim 1, comprising a fourth wall substantially opposite the third wall, wherein the shielding shell further comprises a second contact portion connected with the second wall by a fourth folded edge, the second contact portion being arranged substantially parallel to the fourth wall and comprising a plurality of contact segments contacting said fourth wall.

6. Shielding shell according to claim 1, wherein at least one pair of the first wall and the second wall, the first wall and the third wall and the second wall and the third wall are arranged substantially perpendicular to each other.

7. Connector comprising a shielding shell according to claim 1.

8. Connector according to claim 7, wherein the connector is a right-angle connector, and wherein the first wall, the second wall and the third wall are arranged mutually substantially perpendicular.

9. Blank for a shielding shell according to claim 1.

10. Shielding shell for a connector comprising a first wall, a second wall, a third wall and a fourth wall, the first wall, the second wall and the third wall being arranged mutually at an angle to each other, the fourth wall being substantially opposite the third wall, the first wall and the second wall being connected to each other by a first folded edge, the first wall and the third wall being connected by another folded edge, and the first wall and the fourth wall being connected by a further folded edge wherein the shielding shell further comprises a first contact portion connected with the second wall by a second folded edge, and a second contact portion connected with the second wall by a third folded edge, the first contact portion being arranged substantially parallel to the third wall and the second contact portion being arranged substantially parallel to the fourth wall, wherein the first contact portion comprises a plurality of contact segments contacting said third wall and the second contact portion comprises a plurality of contact segments contacting said fourth wall, where the third wall comprises a first deflectable portion forming a leading edge of the third wall which is shaped such that the first contact portion is guided onto a surface of the third wall upon engaging the first deflectable portion, where the fourth wall comprises a second deflectable portion forming a leading edge of the fourth wall which is shaped such that the second contact portion is guided onto a surface of the fourth wall upon engaging the second deflectable portion, and where the leading edges of the third and fourth walls at the first and second deflectable portions are inwardly deflectable by the contact portions as the contact portions come into contact with the third and fourth walls, where the third wall comprises a plurality of separate segments formed by at least one slot into the leading edge of the third wall, and where at least one of the separate segments comprises the first deflectable portion.

11. Shielding shell for a connector comprising a first wall, a second wall, a third wall and a fourth wall, the first wall, the second wall and the third wall being arranged mutually at an angle to each other, the fourth wall being substantially opposite the third wall, the first wall and the second wall being connected to each other by a first folded edge, wherein the shielding shell further comprises a first contact portion connected with the second wall by a second folded edge, and a second contact portion connected with the second wall by a third folded edge, the first contact portion being arranged substantially parallel to the third wall and the second contact portion being arranged substantially parallel to the fourth wall, wherein the first contact portion comprises a plurality of contact segments contacting said third wall and the second contact portion comprises a plurality of contact segments contacting said fourth wall, wherein the first contact portion is shaped to engage the third wall and the second contact portion is shaped to engage the fourth wall during folding the first wall and the second wall along the first folded edge and wherein the at least one of the first contact portion, the second contact portion, the third wall and the fourth wall is provided with a leading edge portion shaped such that the first contact portion is guided onto a surface of the third wall upon engaging the third wall and the second contact portion is guided onto a surface of the fourth wall upon engaging the fourth wall, respectively, where the leading edge portion of the third wall comprises a first deflectable portion forming at least part of a leading edge of the third wall which is shaped such that the first contact portion is guided onto the surface of the third wall upon engaging the first deflectable portion, where the leading edge portion of the fourth wall comprises a second deflectable portion forming at least part of a leading edge of the fourth wall which is shaped such that the second contact portion is guided onto the surface of the fourth wall upon engaging the second deflectable portion, and where the leading edges of the third and fourth walls at the first and second deflectable portions are inwardly deflectable by the first and second contact portions as the first and second contact portions respectively come into contact with the third and fourth walls, where the third wall comprises a plurality of separate segments formed by at least one slot into the leading edge of the third wall, and where at least one of the separate segments comprises the first deflectable portion.

* * * * *